US006516965B1

(12) United States Patent
Perkins

(10) Patent No.: US 6,516,965 B1
(45) Date of Patent: Feb. 11, 2003

(54) STACKABLE COLLAPSIBLE CONTAINER

(75) Inventor: David W. Perkins, Hiawatha, IA (US)

(73) Assignee: Paper Systems, Inc., Des Moines, IA (US)

( * ) Notice: Subject to any disclaimer, the term of this patent is extended or adjusted under 35 U.S.C. 154(b) by 11 days.

(21) Appl. No.: 09/879,711

(22) Filed: Jun. 12, 2001

(51) Int. Cl.[7] ..... B65D 33/00

(52) U.S. Cl. ..... 220/9.4; 220/9.1; 220/9.2; 220/1.5

(58) Field of Search ..... 220/1.5, 9.1, 9.2, 220/9.4

(56) References Cited

U.S. PATENT DOCUMENTS

| | | | | |
|---|---|---|---|---|
| 1,161,336 A | * | 11/1915 | Potucek | 220/9.2 |
| 1,507,977 A | * | 9/1924 | Schaefer | 220/9.1 X |
| 3,094,361 A | * | 6/1963 | Poyer | 220/9.2 X |
| 3,372,725 A | * | 3/1968 | Voorhees | 220/9.2 X |
| 3,410,328 A | * | 11/1968 | Sasai | 220/9.2 |
| 3,949,874 A | | 4/1976 | Heavner | |
| 4,383,609 A | | 5/1983 | Lochmiller | |
| 4,392,606 A | | 7/1983 | Fremion | |
| 4,606,461 A | | 8/1986 | Bolton, Sr. | |
| 4,691,859 A | | 9/1987 | Snyder | |
| 4,729,505 A | | 3/1988 | Remaks et al. | |
| 4,880,141 A | | 11/1989 | Gossler et al. | |
| 4,949,898 A | | 8/1990 | Nederveld | |
| 5,215,248 A | | 6/1993 | Moser | |
| 5,501,395 A | | 3/1996 | McElroy | |
| 5,549,341 A | | 8/1996 | Chase et al. | |
| 5,746,343 A | * | 5/1998 | Waltke et al. | 220/9.2 |
| 5,934,474 A | | 8/1999 | Renninger et al. | |
| 5,944,252 A | | 8/1999 | Connelly et al. | |
| 6,000,549 A | | 12/1999 | Perkins | |
| 6,029,884 A | | 2/2000 | Roeland | |
| 6,050,410 A | | 4/2000 | Ouirion | |
| 6,074,331 A | | 6/2000 | Ruggiere, Sr. | |
| 6,164,453 A | | 12/2000 | Perkins | |

* cited by examiner

*Primary Examiner*—Steven Pollard
(74) *Attorney, Agent, or Firm*—Brett Trout

(57) ABSTRACT

A stackable collapsible container for flowable materials is provided, having a flexible outer skin and a rigid support having a top, a bottom and a middle. Means are provided for coupling the top of the rigid support to the flexible outer skin and for securing the bottom of the rigid support against substantial movement relative to the flexible outer skin.

10 Claims, 6 Drawing Sheets

STACKABLE COLLAPSIBLE CONTAINER

BACKGROUND OF THE INVENTION

1. Field of the Invention

The present invention relates to bulk containers for flowable materials, and, more specifically, to a flexible bulk container system which is stackable both in use and in storage, and is collapsible to facilitate more compact storage and transportation.

2. Description of the Prior Art

It is known in the art to provide rigid containers, such as drums, for the storage and transportation of flowable or fluid materials. Such prior art drums, however, are bulky and heavy, even when not in use. Also, by utilizing the strength attributes of a circular exterior, such drums do not maximize space most efficiently. Accordingly, when such drums are placed on a pallet, there are substantial open interior spaces, which could be better utilized to store flowable materials.

It is also known in the art to reduce weight by providing a container of a flexible, circular construction, which may be collapsed for transportation and storage after use. While such containers utilize space somewhat more efficiently than drums, are somewhat lighter than drums, and may be reduced in size for storage, such containers do not maximize the available space for storage of flowable materials. Additionally, since such containers do not possess rigid sides, they cannot be stacked, thereby substantially reducing their ability to maximize utilization of warehouse space.

While it is known in the art to provide rigid, square containers, maximizing the space allocation and allowing for the containers to be stacked, such containers are typically heavy, expensive, and difficult to collapse for storage or transportation when not in use.

It is also known in the art to provide collapsible containers with rigid side supports to allow for the containers to be stacked. One drawback associated with this construction is that such containers typically require strapping material or other securement mechanisms to be provided across the top of the container, thereby reducing access to the top of the container and preventing the container from being used in association with many flowable material filling systems. Also, such containers are typically of a cylindrical construction, thereby preventing them from utilizing space most efficiently.

Accordingly, it is desirable to provide a container for flowable materials which is of a low-cost, lightweight construction, easily collapsible for storage and transportation when not in use, stackable, and which provides a large access area into the container from the top of the container. The difficulties encountered in the prior art heretofore are substantially eliminated by the present invention.

SUMMARY OF THE INVENTION

The present invention relates to a stackable, collapsible container having a flexible outer skin and a rigid support. The rigid support has a top, bottom and a middle, and means for securing the top and bottom of the rigid support against substantial movement relative to the flexible outer skin.

Preferably, the container is substantially square in cross-section and is provided with four rigid supports and a reinforcing band around its top perimeter. The tops of the four rigid supports are secured to the reinforcing band, and the bottom of the rigid supports are connected to the opposing rigid support across the bottom of the flexible outer skin, using strapping material such as that known in the art.

It is an object of the present invention to provide a flowable materials container which is low cost.

It is another object of the present invention to provide a flowable materials container which is lightweight.

It is still another object of the present invention to provide a flowable materials container which may be stacked upon itself when filled.

It is yet another object of the present invention to provide a flowable materials container which efficiently utilizes available warehouse space efficiently.

It is another object of the present invention to provide a flowable materials container which may be used in association with standard pallets.

DETAILED DESCRIPTION OF THE PREFERRED EMBODIMENT

Figure 1:
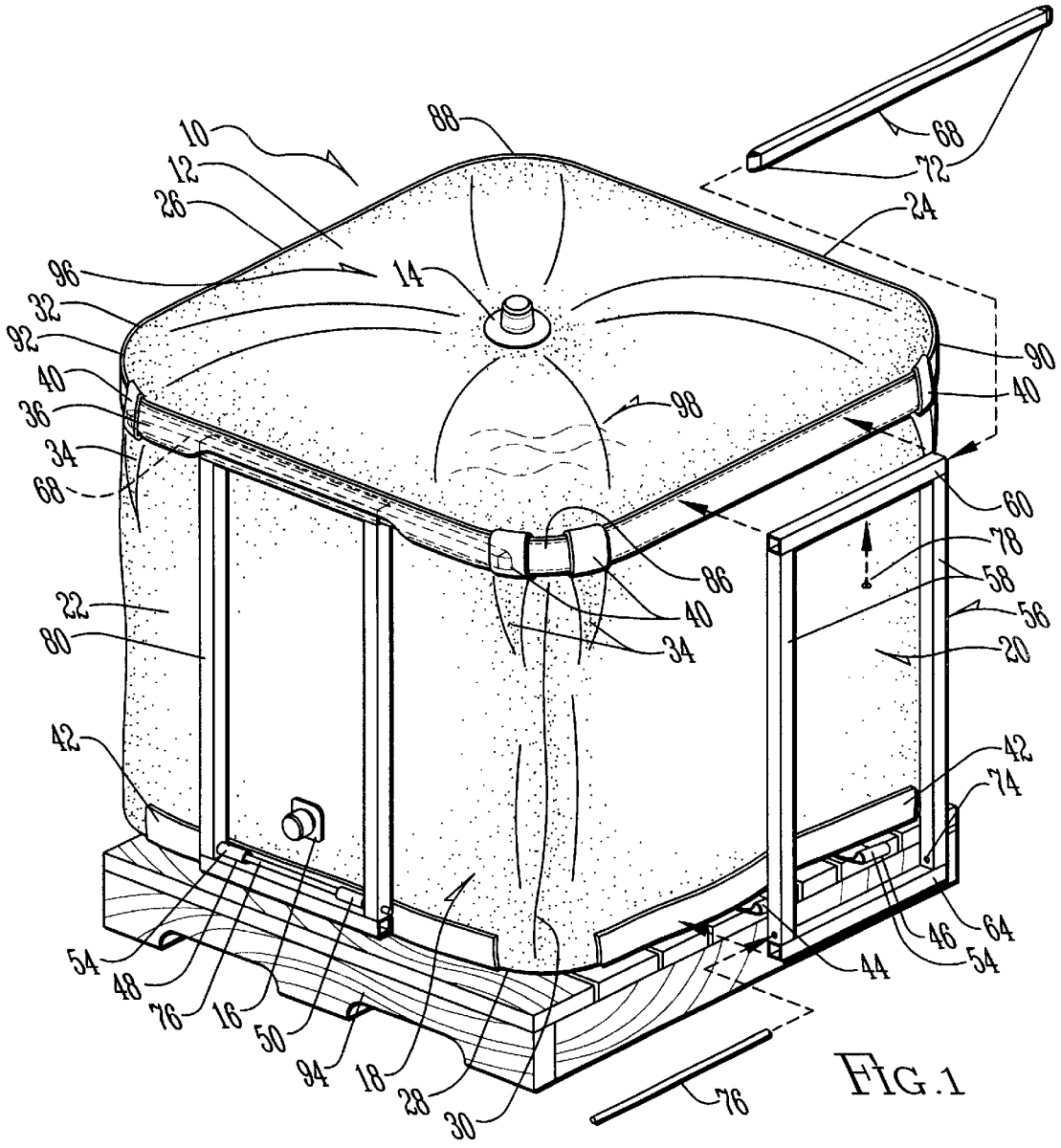
FIG. 1 is perspective view of the stackable, collapsible container of the present invention.

A stackable, collapsible container for flowable materials is shown generally as (10) in FIG. 1. The container (10) includes a removable flexible liner (12) having an inlet opening with a top cap (14) and a drain or outlet opening with a threaded plug (16) therein. Preferably, the removable flexible liner (12) is constructed of polyethylene, such as that well known in the art to hold non-hazardous, fluent material. The container (10) includes an outer skin (18). In the preferred embodiment, the outer skin (18) is constructed of a woven polypropylene fabric-like material. The outer skin (18) can be constructed of any lightweight material known in the art having strength characteristics sufficient to contain a flowable material. The outer skin (18) includes a first side (20), a second side (22), a third side (24), a fourth side (26) and a bottom (28). It is preferable that the outer skin (18) be waterproof, or coated with a waterproof material, in a manner such as that well known in the art to allow the container (10) to be used outdoors as well as indoors.

Figure 2:
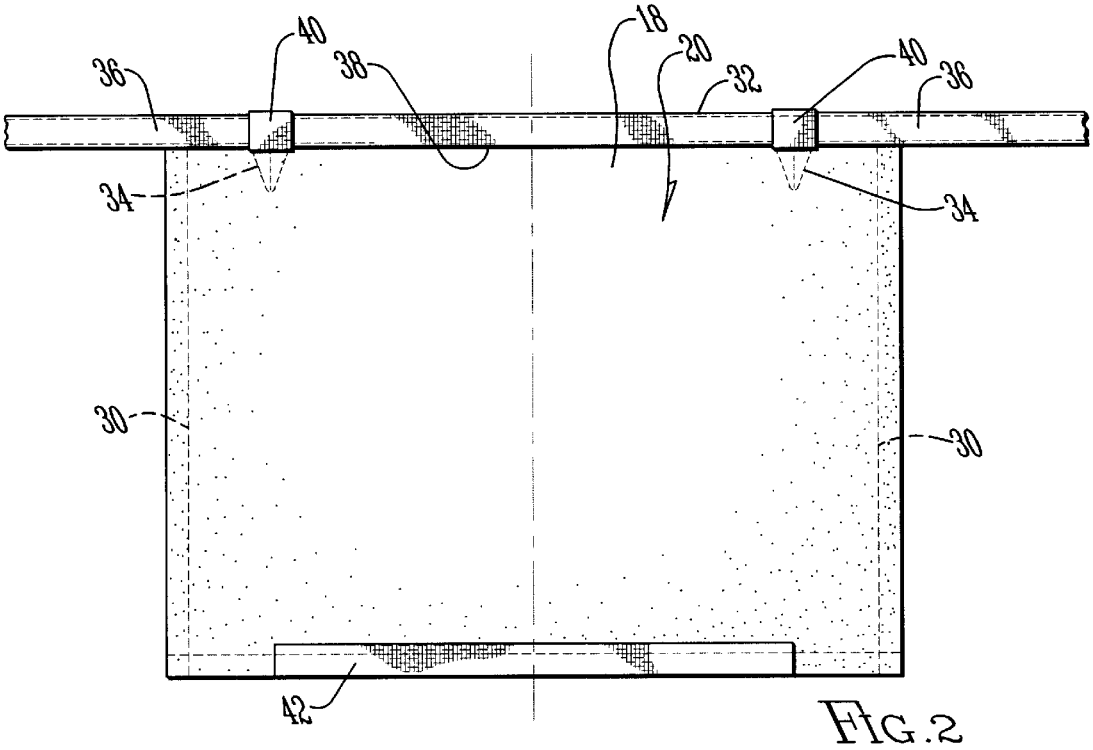
FIG. 2 is a side elevation of the stackable, collapsible container of FIG. 1.

As shown in FIG. 2, in the preferred embodiment the first side (20), as well as all remaining sides (22), (24) and (26), are preferably 45 inches wide and 38½ inches deep. The sides are actually somewhat larger than these dimensions, to allow the sides to overlap and be sewn together to form a seam (30) to create a container with these dimensions. Preferably, 15½ inches on either side of the center line of the first side (20), along the top perimeter (32) of the first side (20), pleats are formed in the first side (20) of the outer skin (18) approximately six inches deep. 2¼ inches of the outer skin (18) is folded upon itself to form a pair of triangular pleats (34) which are then stitched. Accordingly, eight such triangular pleats (34) are provided along the top perimeter (34) of the outer skin (18) to pull the corners of the container (10) inward.

As shown in FIG. 2, a reinforcement strap (36), comprising a three inch wide strip of polyester webbing, such as that used in seatbelt applications, is sewn to the top perimeter (32) of the container (10). Preferably, the reinforcement strap (36) is sewn along its top and its bottom within ¼ inch from each of its edges. At 9½ inches on either side of the centerline of the first side (20), and all other sides (22), (24) and (26), the lower edge of the reinforcement strap (36) is not sewn. This sewing construction provides access to an interior (38) located between the reinforcement strap (36) and the outer skin (18).

As shown in FIG. 2, an additional wear pad (40), constructed of similar seatbelt material and approximately 4 inches long, is sewn over the reinforcement strap (36), so that the center of the wear pad (40) is located approximately 15½ inches from either side of the center line of the first side (20) and all additional sides (22), (24) and (26). A wear strap (42) comprising a 28 inch long piece of 3 inch side seatbelt material is sewn to the bottom (28) and each side (20–26) of the outer skin (18) to increase the wear characteristics of the container (10).

Figure 3:
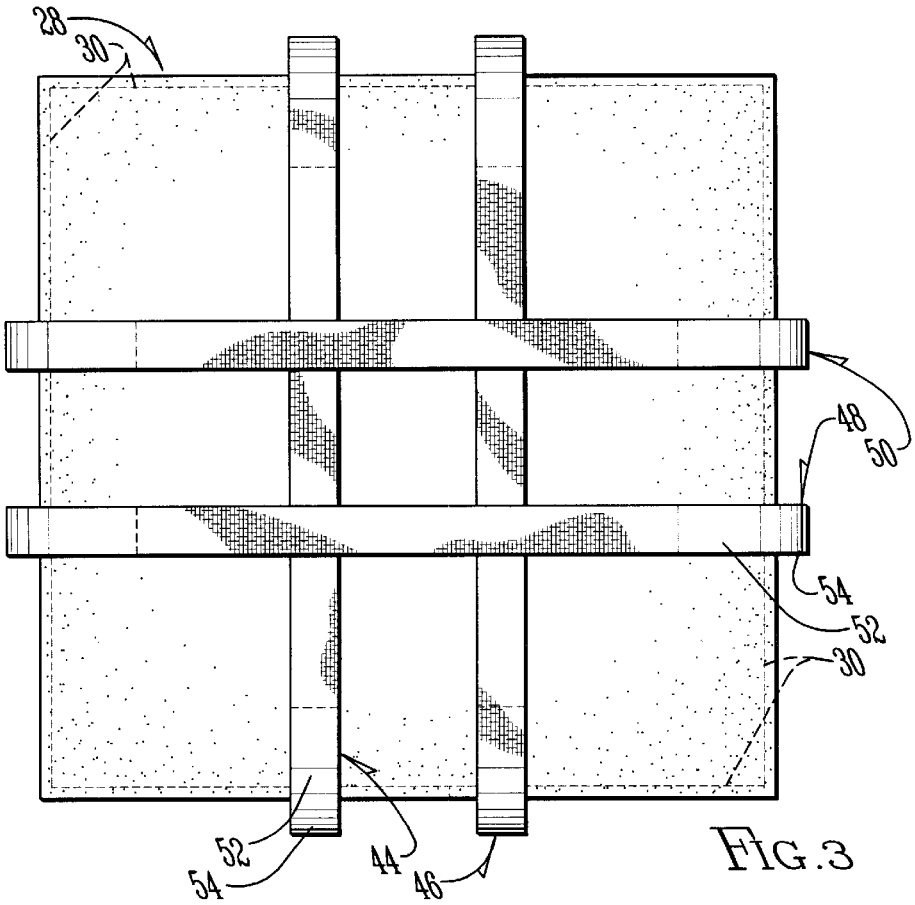
FIG. 3 is a bottom elevation of the stackable, collapsible container of FIG. 1.

As shown in FIG. 3, provided across the bottom (28) of the outer skin (18) are a first strap (44), a second strap (46), a third strap (48) and a fourth strap (50). The straps are constructed of seat belt webbing material and are 68½ inches long and 3 inches wide, each being provided with a doubled back portion (52) sewn to form a loop (54).

Figure 4:
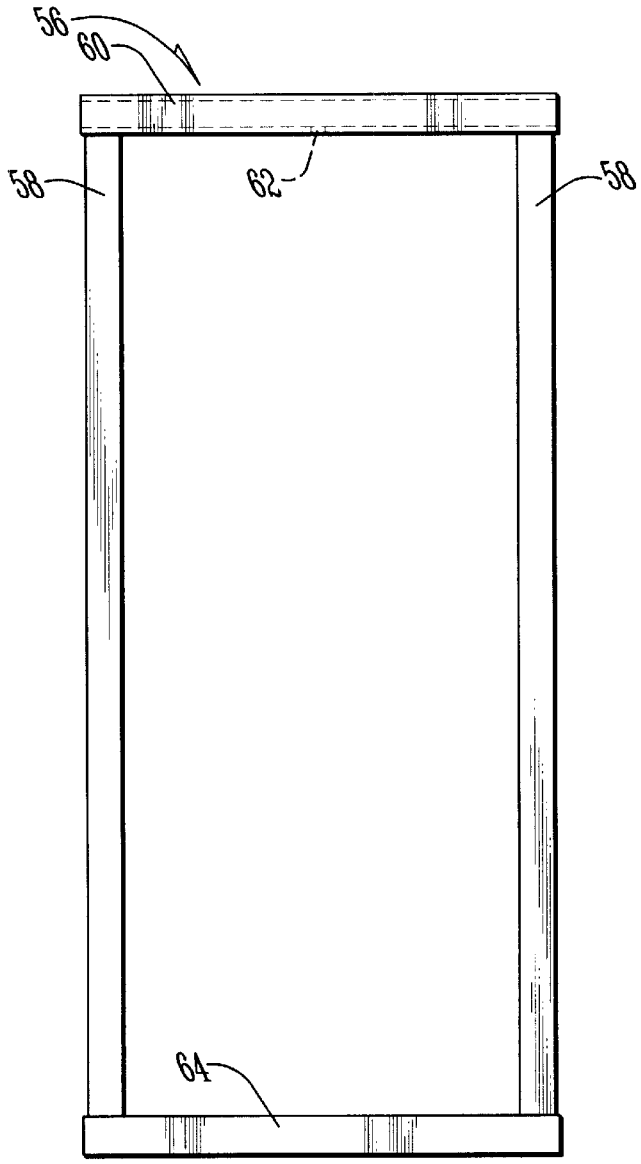
FIG. 4 is a side elevation of the rigid support of the present invention.

As shown in FIG. 4, a first support member (56) is provided having a pair of sidebars (58), a top bar (60) having a hole (62), and a bottom bar (64). The top bar (60) and bottom bar (64) are preferably 17½ inches in length and the sidebars (58) are preferably 35¼ inches long. The side bars (58) are preferably 1¼ inch square tubes constructed of eleven gauge steel, while the top bar (60) and bottom bar (64) are 1½ inch square tubes constructed of thirteen gauge steel. The side bars (58), top bar (60) and bottom bar (64) are preferably welded to one another to form the rectangular structure shown in FIG. 4, approximately 37¾ inches but may be secured together by any suitable means known in the art.

Figure 5:
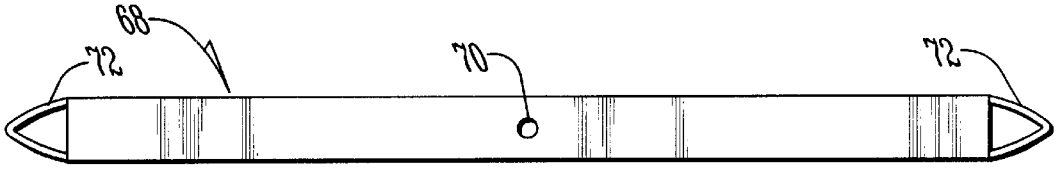
FIG. 5 is a bottom elevation of the cross member of the rigid support of FIG. 4.

As shown in FIG. 5, a cross member (68) is constructed of one inch square tube constructed of fourteen-gauge steel. Welded to either end of the cross member (68) are curved end pieces (72). The end pieces (72) are constructed of 1 inch, by 1¾ inch, by ⅛ inch strips of steel, bent to form a taper when the curved end pieces (72) are welded to the cross member (68). As shown in FIG. 1, the sidebars (58) are provided with holes (74) through which is provided a steel bar (76), preferably ½ inch in diameter.

To assemble the container (10) of the present invention, the reinforcement strap (36) is lifted near the center and the top bar (60) of the first support member (56) is provided underneath. The first support member (56) is then tilted slightly to expose one end of the top bar (60). The cross member (68) is then inserted through the top bar (60) and into the interior (38) formed between the reinforcement strap (36) and the outer skin (18) of the container (10). As shown in FIG. 5, the length of the cross member (68) is 31¾ inches and the cross member (68) is inserted sufficiently into the interior (38) of the container (10) to allow the top bar (60) to be reinserted between the reinforcement strap (36) and outer skin (18). Once the top bar (60) has been so reinserted, the cross member (68) is centered relative to the top bar (60) so that the curved end pieces (72) are positioned within the interior (38) of the container (10) on either side of the first support member (56). Preferably, the cross member (68) is oriented so that the reinforcement strap (36) conforms at least partially to the taper defined by the curved end pieces (72) of the cross member (68). Once the cross member (68) is centered relative to the top bar (68), the hole (62) in the top bar (60) and hole (70) in the cross member (68) are aligned so that a pop rivet (78) may be inserted through the holes (62) and (70) to prevent undesired movement of the cross member (68) relative to the top bar (60). Thereafter, the first strap (44) and second strap (46) are pulled over the bottom bar (64) and the cylindrical bar (76) is inserted through the holes (74) provided in the side bars (58) and the loops (54) provided in the first strap (44) and second strap (46). The cylindrical bar (76) may then be welded, bolted or otherwise secured to the side bars (58). After the first support member (56) has been so secured to the outer skin (18), a second support member (80), a third support member (82) and a fourth support member (84) are similarly secured to the outer skin (18).

Figure 6:
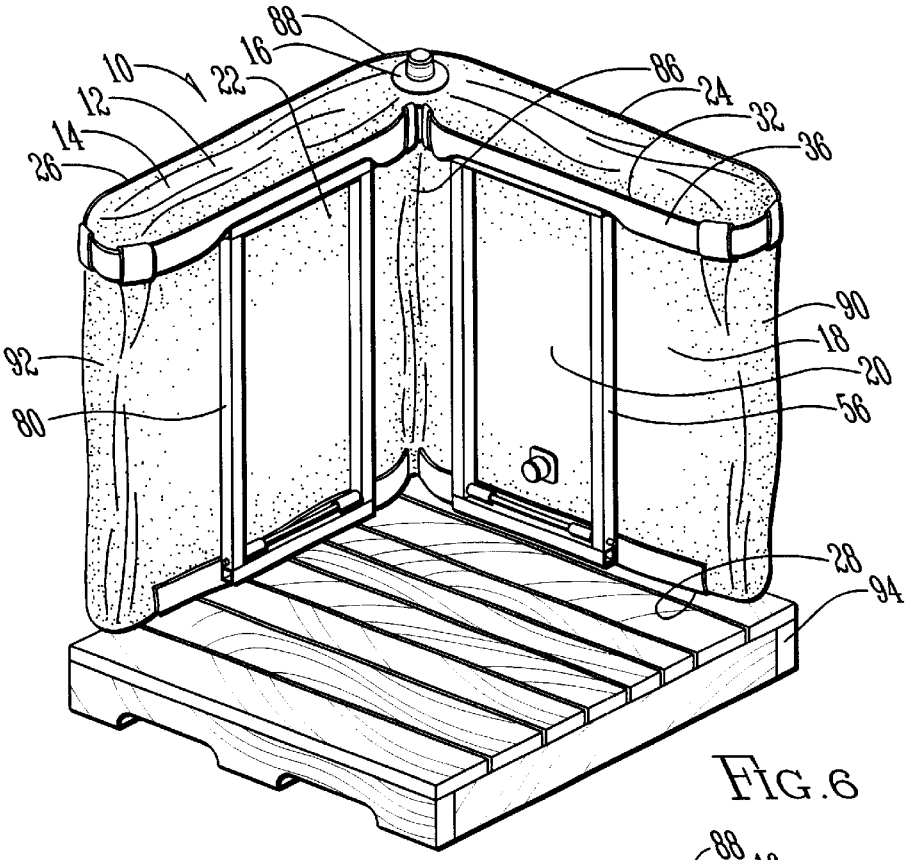
FIG. 6 is a perspective view showing the stackable, collapsible container partially folded for transportation or storage.
Figure 7:
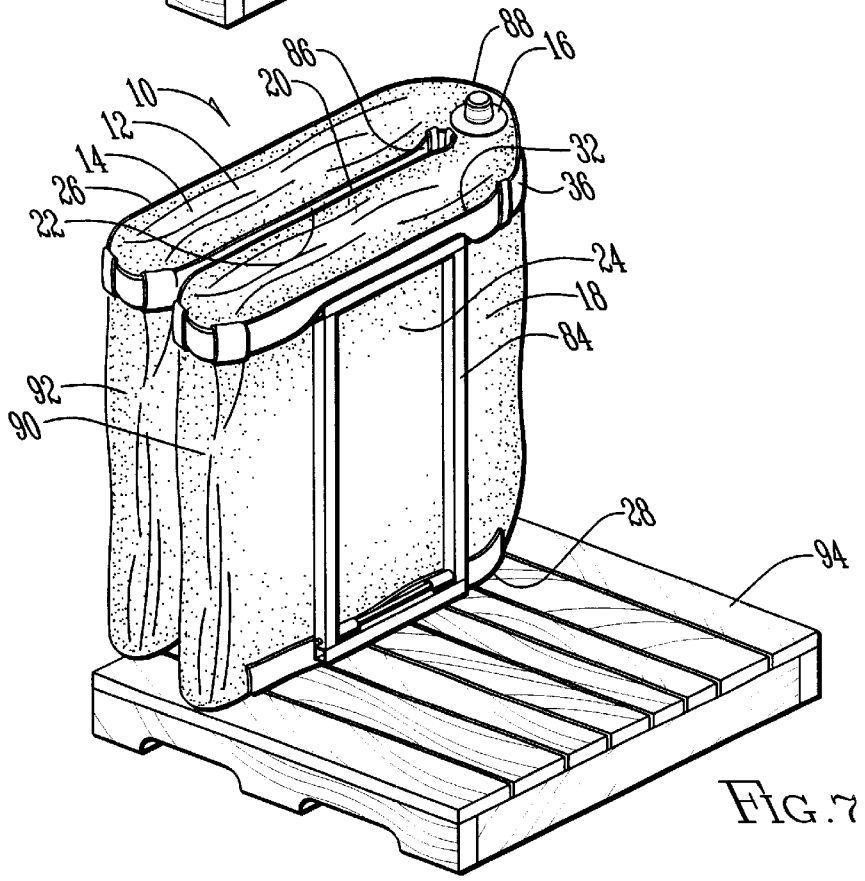
FIG. 7 shows the stackable, collapsible container of FIG. 1 completely folded for storage or transportation.

Once the container (10) has been assembled as described above, the container (10) may be collapsed, as shown in FIG. 6, by pushing one corner (86) of the container (10) toward an opposing corner (88) and then, as shown in FIG. 7, folding the remaining two corners (90) and (92) toward one another to substantially flatten the container (10). This structure is compact, lightweight, and easily storable or transportable. Other methods of folding the container (10) with or without the support members (56), (80), (82) and (84) being removed are contemplated and would be obvious to those skilled in the art.

It is contemplated that the bottom (28) of the outer skin (18) may be eliminated as the container (10) may be placed on a sufficiently supported pallet (94) prior to inserting and filling the liner (12). In this embodiment, the pallet (94) can be positioned in supporting or load bearing relation under the liner (12) of the container (10). Thus, the sides (20–26) of the outer skin (18) and the support members (56) and (80–84) are supported by the pallet (94).

Figure 8:
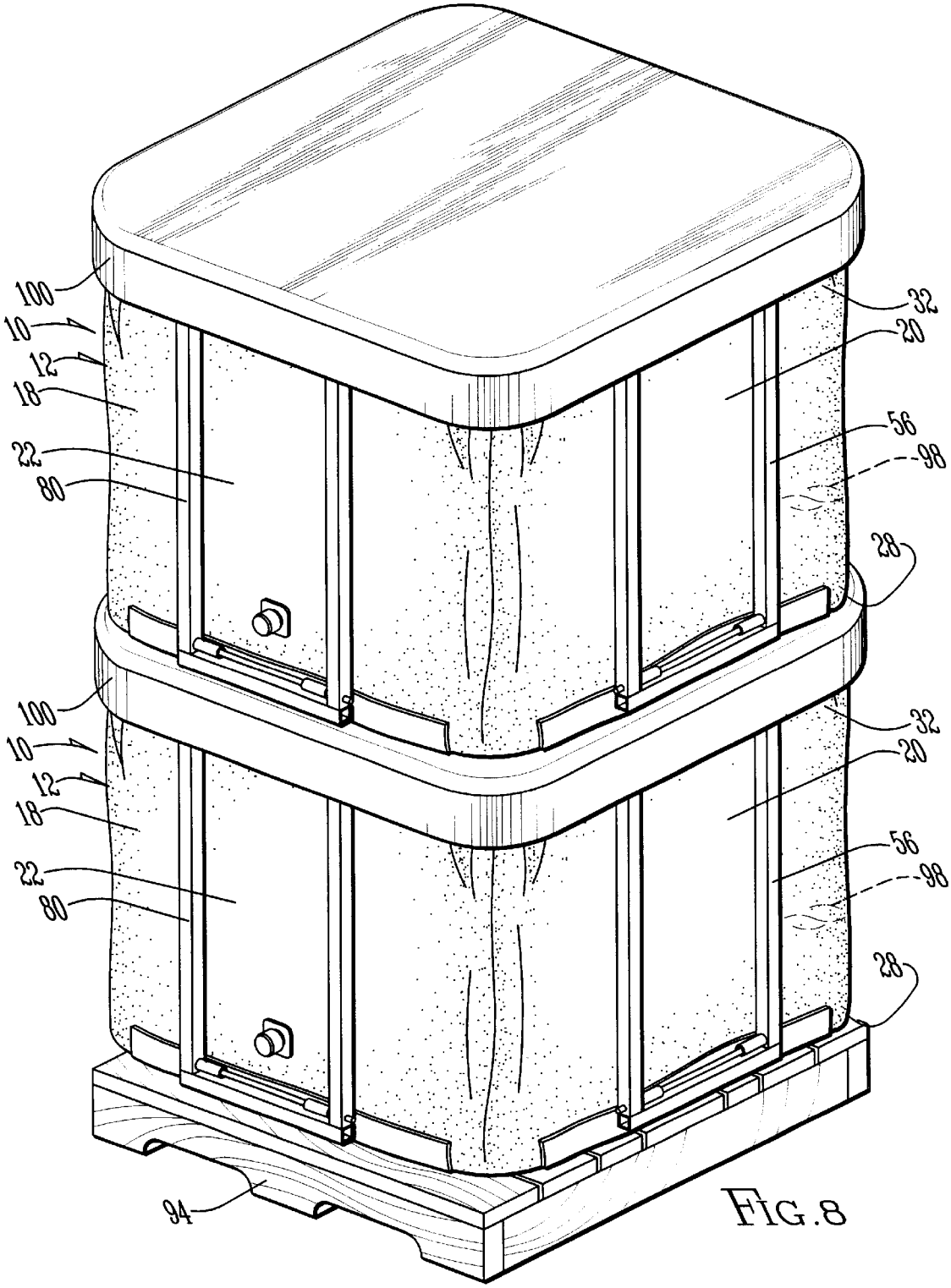
FIG. 8 is a partial cutaway view of the stackable, collapsible container of the present invention, provided with a lid and stacked upon a second stackable, collapsible container of similar construction.

In the preferred embodiment, the container (10) is unfolded and positioned on the pallet (94) as shown in FIG. 1. The large opening (96) allows a very large fill head (not shown) to enter the container (10) and couple to the top cap (14) to fill the container (10). As the container (10) fills with flowable material (98), hydrostatic pressure forces the sides (20–26) of the outer skin (18) outward toward the edges of the pallet (94). By pressing outward equally on the sides (20–26) of the container (10), the flowable material (98) actually hydraulically stabilizes or "hydro stabilizes" the sides (20–26) of the container (10), keeping them vertical and rigid for stacking purposes. The support members (56) and (80–84), prevent the container (10) from collapsing upon itself, and provide compressive strength when the containers (10) are stacked upon one another as shown in FIG. 3. As shown in FIG. 8, the support members (56) align with one another so that the downward force of the weight of the flowable material (98) passes through the support members (56) to the pallet (94). Also as shown in FIG. 8, the container (10) may be provided with a lid (100) constructed of rigid or flexible material in any manner known in the art.

Figure 9:
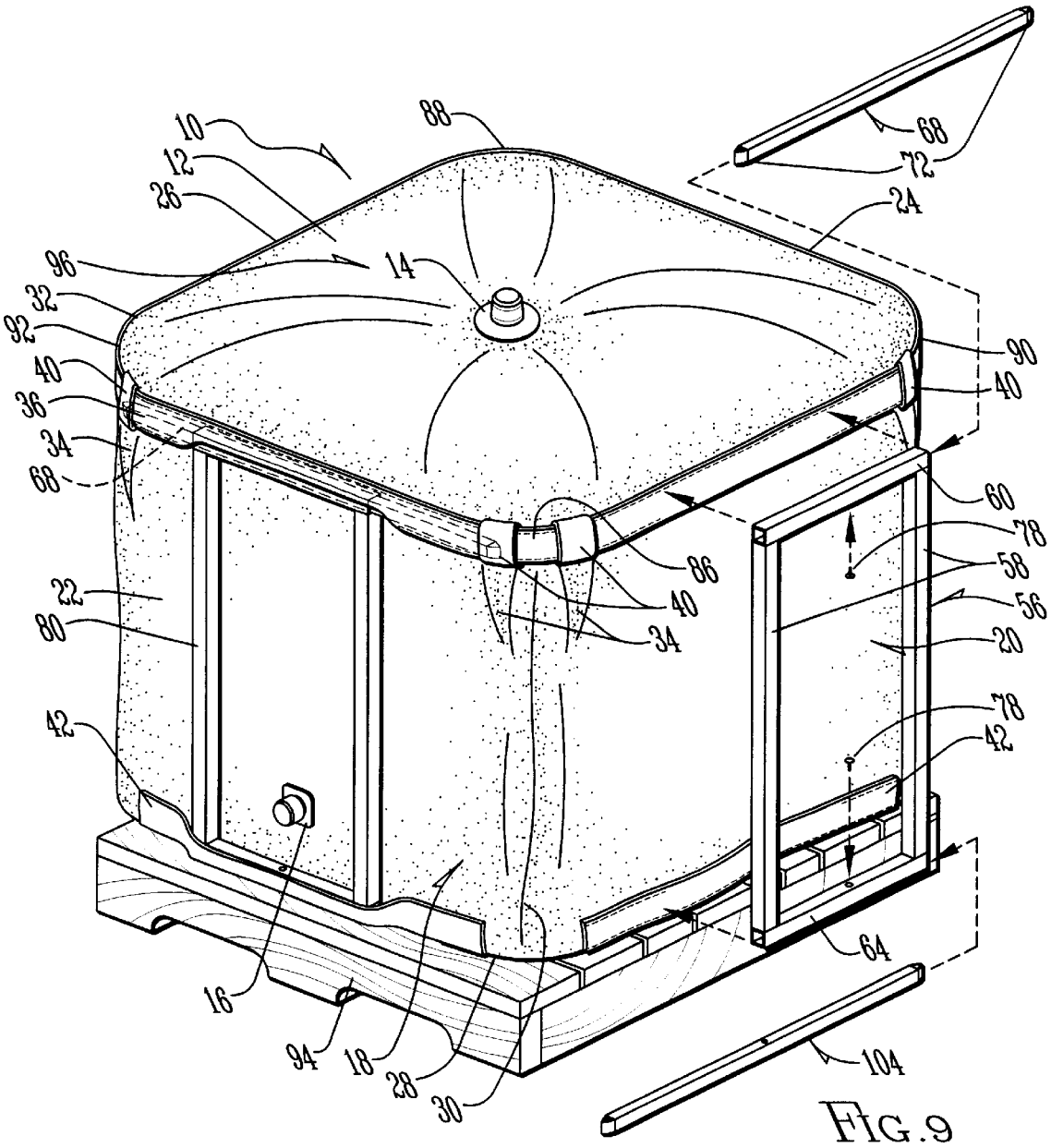
FIG. 9 is an alternative embodiment of the stackable, collapsible container of the present invention, utilizing a circular rod to contain the cross straps on the bottom of the container.

Shown in FIG. 9 is an alternative embodiment of the present invention in which the straps (44–50) may be eliminated and the wear strap (42) stitched as described, above in reference to the preferred embodiment of the enforcement strap (36). In this embodiment, instead of a cylindrical bar (76), a second cross member (104) may be inserted as described above in relationship to the cross member (68) and pop riveted to the bottom bar (64).

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. By way of example, the container (10) may be constructed of any desired material, of any suitable dimensions, and may be provided with any desired number of sides. Additionally, the support members (56) and (80–84) may be of any desired construction and coupled to the outer skin (18) by any desired means.

What is claimed is:

1. A collapsible container comprising:

(a) a flexible outer skin;

(b) a rigid support having a top, a bottom and a middle;

(c) means for securing said top of said rigid support against substantial movement relative to said flexible outer skin;

(d) means for securing said bottom of said rigid support against substantial movement relative to said flexible outer skin; and (e) wherein said flexible outer skin comprises a side and a bottom coupled together, and wherein said bottom securing means is a strap extending at least partially across said bottom.

2. The collapsible container of claim 1, wherein said top securing means is means for coupling said top of said rigid support to said flexible outer skin.

3. The collapsible container of claim 1, wherein said middle of said rigid support is substantially unsecured to said flexible outer skin.

4. The collapsible container of claim 1, wherein said flexible outer skin is of a generally square cross-section when filled with flowable material.

5. The collapsible container of claim 1, wherein said top securing means is a strap provided around said flexible outer skin.

6. The collapsible container of claim 1, wherein said top securing means is a supportive material defining an interior, wherein at least a portion of said top of said rigid support extends into said interior of said supportive material.

7. A collapsible container comprising:

(a) a flexible outer skin;

(b) a rigid support having a top, a bottom and a middle, wherein said top of said rigid support is a top bar having a first end, a second end, and a middle;

(c) means for securing said top of said rigid support against substantial movement relative to said flexible outer skin, wherein said top securing means is a supportive material defining a first interior and a second interior, wherein at least a portion of said first end of said top bar extends into said first interior, wherein at least a portion of said second end of said top bar extends into said second interior, and wherein said middle of said top bar is coupled to said top of said rigid support; and (d) means for securing said bottom of said rigid support against substantial movement relative to said flexible outer skin.

8. The collapsible container of claim 7, wherein said bottom of said rigid support is a bottom bar having a first end, a second end and a middle, wherein said bottom securing means is a supplemental supportive material, defining a third interior and a fourth interior, wherein at least a portion of said first end of said bottom bar extends into said third interior, wherein at least a portion of said second end of said bottom bar extends into said fourth interior, and wherein said middle of said bottom bar is coupled to said bottom of said rigid support.

9. The collapsible container of claim 7, wherein said bottom securing means is a strap coupled to said bottom of said rigid support.

10. The collapsible container of claim 9, further comprising a supplemental rigid support having a top, a bottom and a middle, wherein said strap is coupled between said bottom of said rigid support and said bottom at said supplemental rigid support.

* * * * *